United States Patent [19]

Paeselt

[11] Patent Number: 5,033,525

[45] Date of Patent: Jul. 23, 1991

[54] DECORATIVE CURTAIN HANGER

[76] Inventor: Guenther Paeselt, 3351 Erie Dr., Orchard Lake, Mich. 48033

[21] Appl. No.: 532,586

[22] Filed: Jun. 4, 1990

[51] Int. Cl.[5] ..... E06D 9/00

[52] U.S. Cl. ..... 160/39; 160/19

[58] Field of Search ..... 160/19, 38, 39, 178.1, 160/902; 16/94 D, 94 R; 248/262, 267, 264

[56] References Cited

U.S. PATENT DOCUMENTS

| | | | |
|---|---|---|---|
| 1,848,618 | 3/1932 | Gandolfo et al. . | |
| 2,293,662 | 8/1942 | Richardson . | |
| 2,637,380 | 5/1953 | Hyde . | |
| 2,998,062 | 8/1961 | Bixby | 160/39 |
| 3,111,162 | 11/1963 | Bierlich . | |
| 3,996,987 | 12/1976 | Rodriguez . | |
| 4,254,813 | 3/1981 | Vecchiarelli . | |
| 4,384,605 | 5/1983 | Schaeffer et al. . | |
| 4,930,562 | 6/1990 | Goodman | 160/38 X |

*Primary Examiner*—Blair M. Johnson

*Attorney, Agent, or Firm*—Basile and Hanlon

[57] ABSTRACT

A decorative valance has a body with an upper and lower edge. The upper edge is turned back on the body of the valance and spaced from the body to form a downwardly facing groove, while the lower edge is turned back on the body of the valance and spaced from the body to form an upwardly facing groove. Cornice padding has upper and lower edges and two ends, with the padding upper edge being received by the downwardly facing groove in the valance, and the padding lower edge being received by the upwardly facing groove in the valance. A mechanism is provided for mounting the valance to a wall.

10 Claims, 3 Drawing Sheets

DECORATIVE CURTAIN HANGER

BACKGROUND OF THE INVENTION

1. Field of the Invention

The present invention relates generally to valances, and more particularly to valances having cornice padding disposed thereon.

2. Description of the Relevant Art

The use of valances and window cornices to hide drapery rods is well known. In order to make window treatments more attractive, people use valances covered with cornice padding and material which either accents or matches the drapery material.

However, attaching cornice padding to the valance is often difficult and time consuming. In addition, it is often expensive due to the amount of labor involved and the precise measurement and attachment of the cornice padding to the valance.

Therefore, it would be desirable to provide a valance wherein the cornice is easily and quickly mounted on the valance body.

SUMMARY OF THE INVENTION

The above problems are solved by the decorative valance of the present invention. The valance comprises a body with an upper and lower edge. The upper edge is turned back on the body of the valance and spaced from the body to form a downwardly facing groove. The lower edge is turned back on the body of the valance and spaced from the body to form an upwardly facing groove. The valance further comprises cornice padding having upper and lower edges and two ends, with the padding upper edge received by the downwardly facing groove. The padding lower edge is received by the upwardly facing groove. Means are provided for mounting the valance to a wall.

BRIEF DESCRIPTION OF THE DRAWINGS

Other objects and features of the invention will become apparent by reference to the following specification and to the drawings in which.

DESCRIPTION OF THE PREFERRED EMBODIMENT

Figure 2:
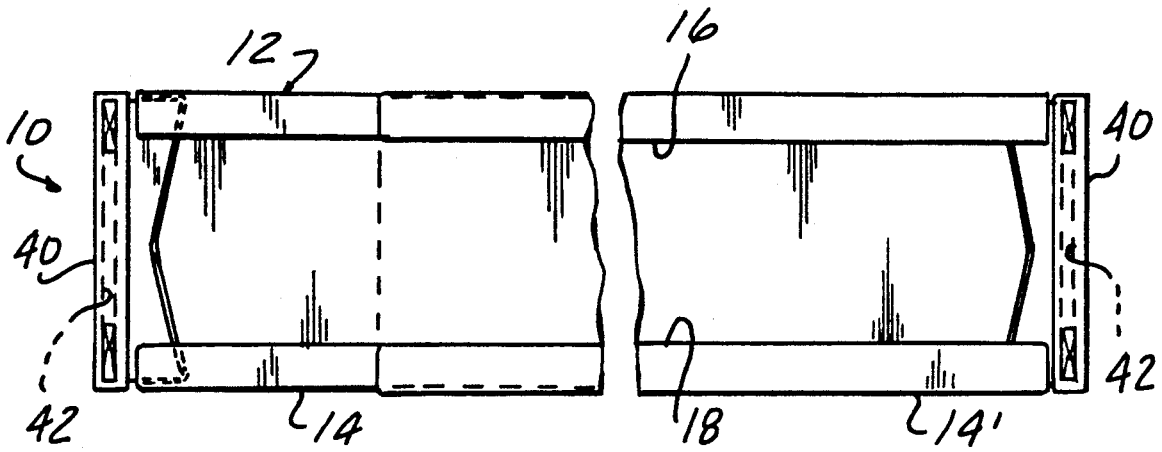
FIG. 2 is a front view of the valance body of the first embodiment, showing the end pieces attached.
Figure 1:
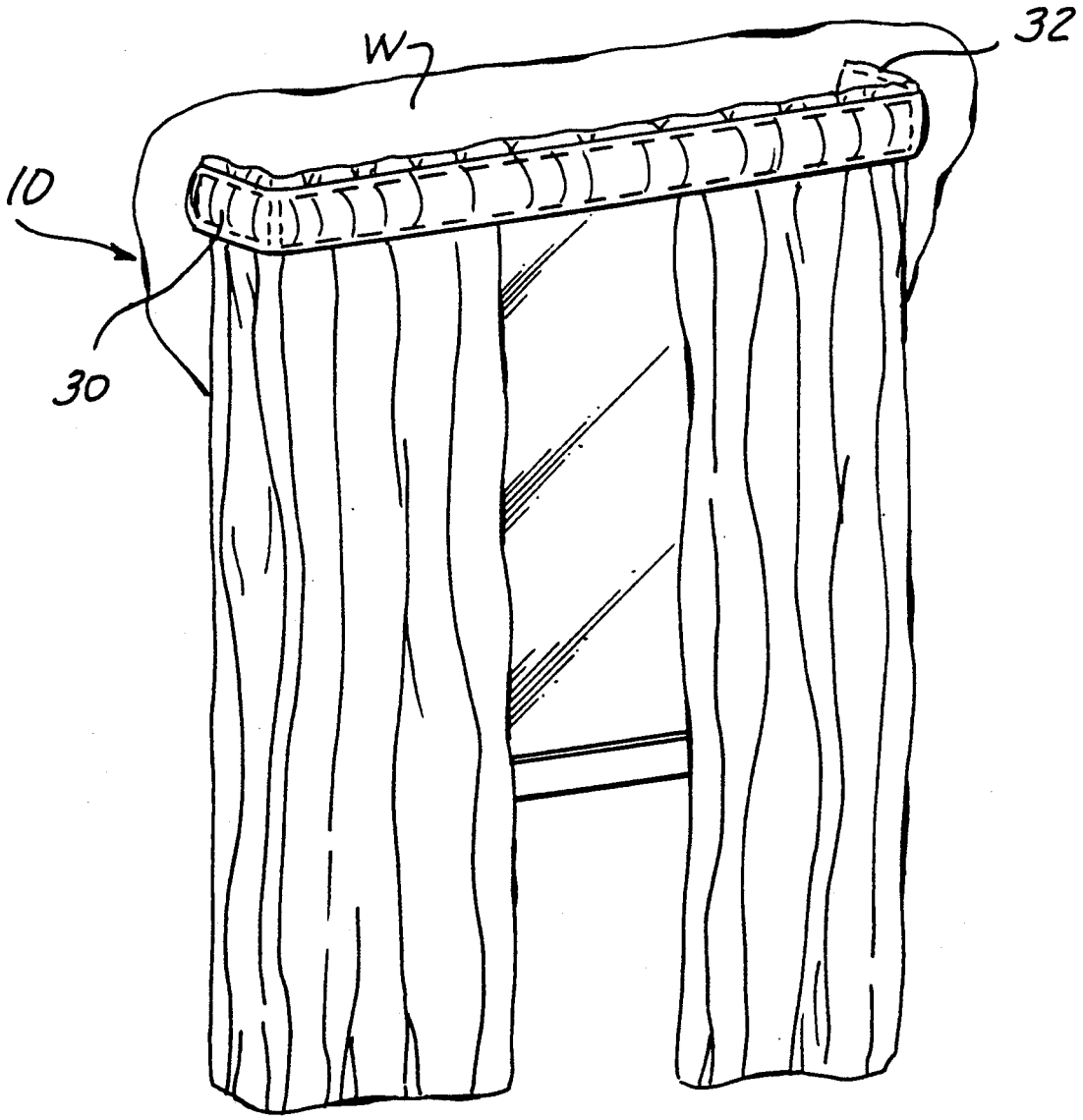
FIG. 1 is a perspective view of a window treatment with the valance of the present invention installed.
Figure 4:
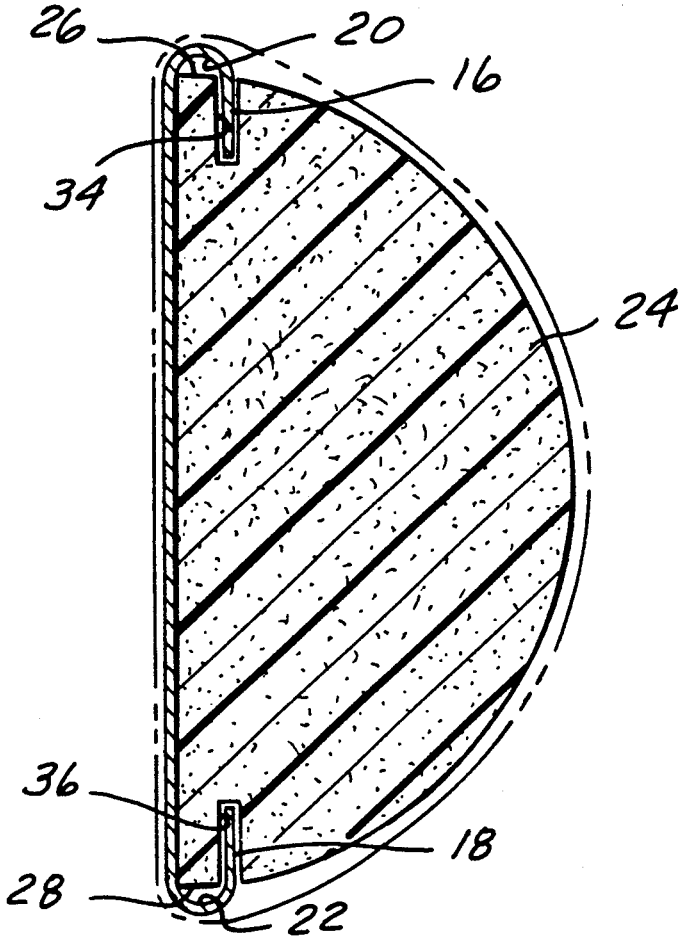
FIG. 4 is a cross sectional view taken on line 4—4 of FIG. 3 showing the cornice padding upper and lower edges received by the downwardly and upwardly facing grooves, respectively, with decorative material shown in phantom.

Referring now to FIG. 1, the decorative valance of the present invention is designated generally as 10. Valance 10 comprises a body 12 as shown in FIG. 2. Body 12 may be formed as one contiguous piece, or it may be comprised of telescoping sections 14, 14' which may adapt to many different sized windows. Valance body 12 has an upper edge 16 and a lower edge 18. Upper edge 16 is turned back on body 12 and spaced from body 12 to form a downwardly facing groove 20 as seen in FIG. 4. Lower edge 18 is turned back on body 12 and spaced from body 12 to form an upwardly facing groove 22.

Cornice padding 24 has an upper edge 26 and a lower edge 28. As seen in FIG. 1, cornice padding 24 has two ends 30, 32. The padding upper edge 26 is received by downwardly facing groove 20, while padding lower edge 20 is received by upwardly facing groove 22. In order to fit the cornice padding upper and lower edges 26, 28 into groove 20, 22 more easily, and to allow the cornice padding 24 to be held more securely, padding 24 may additionally comprise a longitudinal groove 34, 36, the grooves 34, 36 being spaced from each of the padding upper and lower edges 26, 28. Grooves 34, 36 receive each of the turned back portions of the valance 16, 18 respectively.

Figure 3:
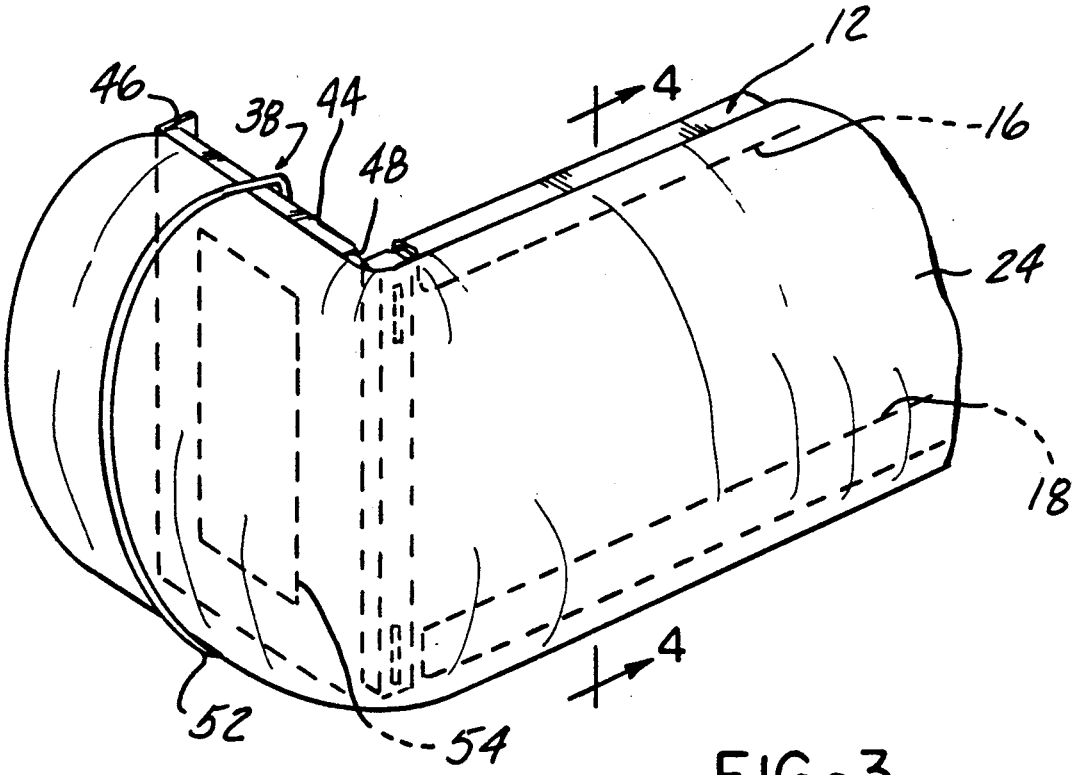
FIG. 3 is a cutaway perspective view of the first embodiment showing an end of the cornice padding attached to the mounting bracket, with the two sided tape shown in phantom.

Valance 10 further comprises means 38 for mounting valance 10 to wall W. Wall mounting means 38 may comprise any suitable, conventional means. In the preferred embodiment, wall mounting means 38 comprises an end piece 40 removably attached to valance body 12, with each end piece 40 having an aperture 42. Wall mounting means 38 further comprises a mounting bracket 44 which has a first end 46 and a second end 48 as shown in FIG. 3. first end 46 has means for attaching bracket 44 to wall W. This bracket attaching means may comprise any conventional means, such as screws and the like. Second end 48 has means for attaching the bracket 44 to aperture 42 in end piece 40. This attaching means may also comprise any suitable means, but in the preferred embodiment this means comprises a tab 50 (as best seen in FIG. 5) for snap-fit attachment with end piece aperture 42.

Valance 10 further comprises means for attaching cornice padding ends 30, 32 to wall mounting means 38. In the preferred embodiment, this means comprises a clip 52 which fits around one end 30 or 32 of the cornice padding 24 and engages mounting bracket 44. Additionally, the cornice padding attaching means may comprise two sided tape 54 which has adhesive coating on each of the two sides. One side of the tape 54 is attached to cornice padding 24, and the other side is attached to wall mounting means 38.

This embodiment of the valance is quick and easy to assemble since the valance body used is actually a conventional valance body. However, this embodiment mounts cornice padding 24 on the side of valance body 12 which would normally face wall W. By using a conventional valance, the invention saves both time and money. since end pieces 40 are removable, they need only be taken out of the valance body 12 and turned around in order to mount the reverse side of valance body 12 toward the wall, with what is conventionally the front of the valance facing the room.

Figure 5:
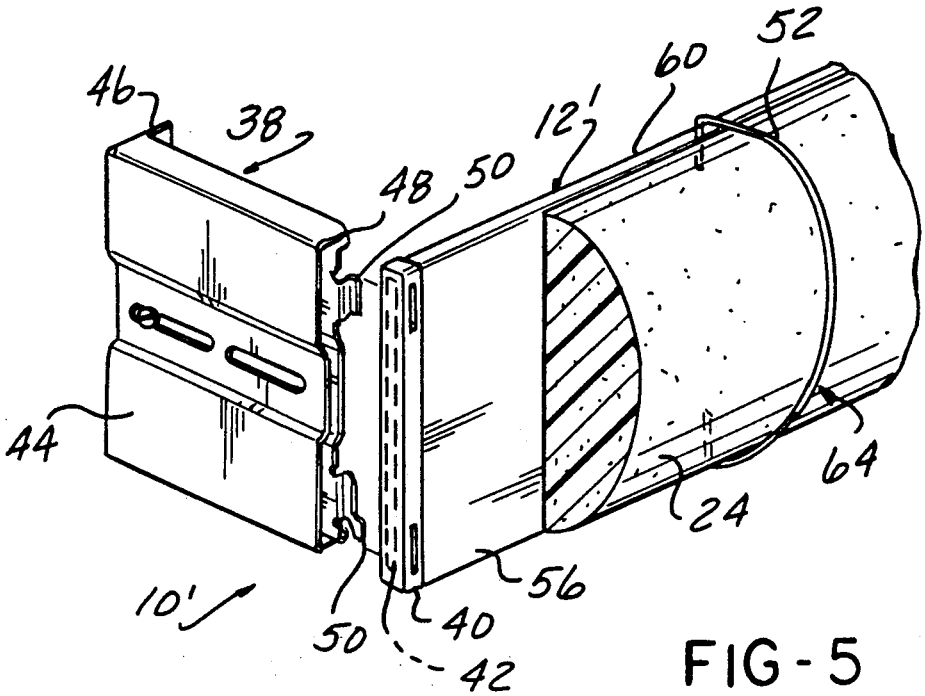
FIG. 5 is an exploded cutaway cross sectional perspective view of the second embodiment of the present invention showing a clip holding the cornice padding in place.
Figure 7:
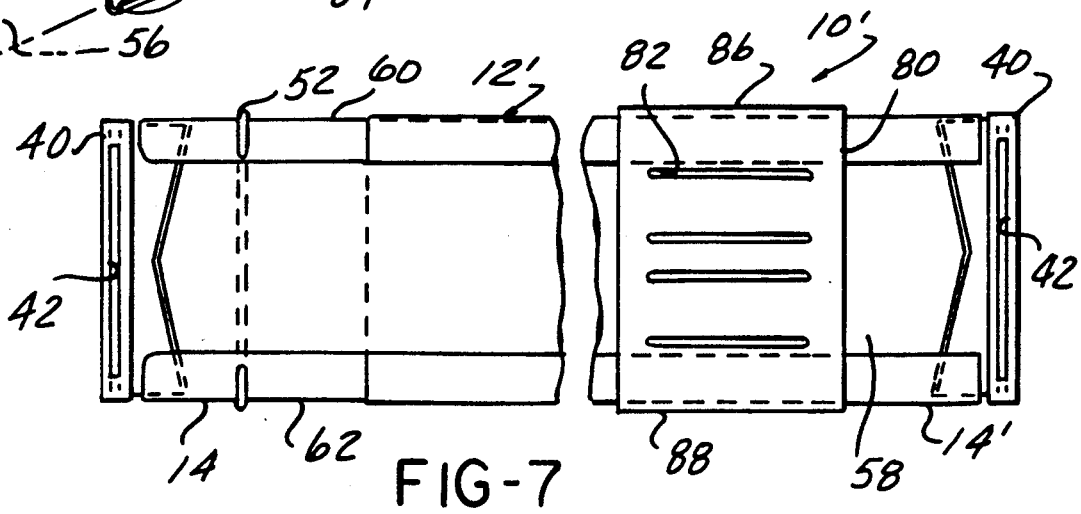
FIG. 7 is a rear view of the valance body of the second embodiment, showing the end pieces attached, a clip holding the cornice padding in place, and the center support bracket attached to the back of the valance body.

The second embodiment of the valance 10' uses valance body 12' in the conventional manner such that the side of the valance to which the cornice padding is conventionally attached is the front 56 of the valance body 12', as seen in FIG. 5. FIG. 7 shows back 58 of valance 10'.

The second embodiment valance body 12' has an upper edge 60, and a lower edge 62. Cornice padding 24 has two ends 30, 32 and is disposed on front 56 of valance body 12'.

As with the first embodiment, valance body 12' may comprise telescoping section 14, 14'. Wall mounting means 38 may comprise any suitable means. In the preferred embodiment, mounting means 38 is the same as for the first embodiment, including end pieces 40, mounting bracket 44, etc.

Valance 10' further comprises means 64 for attaching cornice padding 24 to the front 56 of valance body 12', and to wall mounting means 38. This cornice padding attaching means 64 may comprise any suitable attaching means, including two sided tape 54 as in the first embodiment. In the preferred embodiment, cornice padding attaching means 64 comprises a clip 52. A first clip 52 fits around cornice padding 24 and engages each of the upper and lower edges 60, 62 respectively of valance body 12', as seen in FIG. 5. The means for attaching the cornice padding end to the wall mounting means 38 is the same as in the first embodiment, namely this may comprise two sided tape 54 and/or clip 52 as shown in FIG. 3.

Figure 6:
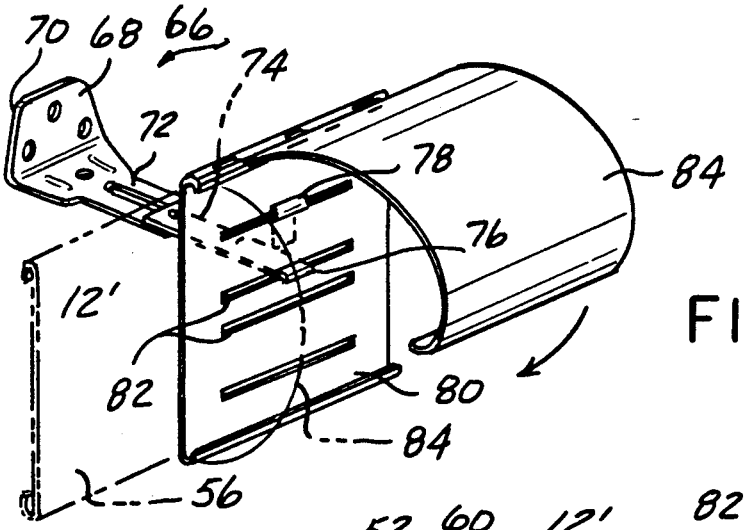
FIG. 6 is a perspective view of the center support bracket, the center support, the wall bracket and the center support cover of the second embodiment, with a portion of the valance body shown in phantom.

Valance 10' further comprises means 66 for supporting valance 10' as seen in FIG. 6. Valance support means 66 provides additional support to the valance. This additional support is especially needed if the valance is of a substantial length to cover a large window. The valance support means 66 is generally positioned near the center of the valance. In the preferred embodiment, valance support means 66 comprises a wall bracket 68 having a first end 70 and a second end 72. First end 70 has means for attaching wall bracket 68 to wall W. Thisi may be any suitable means including screws and the like. Second end 72 has a center support 74 attached thereto by any suitable means, also including screws and the like. Center support 74 has two legs 76, 78. Leg 76 is in an L-shape, and leg 78 is in the shape of three contiguous L's. A center support bracket 80 engages each of the upper and lower edges 60, 62 respectively of valance body 12' and covers the back 58 of valance body 12'. Center support bracket 80 has longitudinal apertures 82 which are spaced to receive the ends of legs 76, 78 of center support 74. The valance support means 66 may additionally comprise a center support cover 84 hingedly attached to an upper edge 86 of center support bracket 80. Cover 84 fits around cornice padding 24 and engages a lower edge 88 of the center support bracket 80. In FIG. 6, center support cover 84 is shown in the open position, with the cover 84 in its closed position shown in phantom.

The materials used for both embodiments may be any conventional material. For example, the cornice padding may be styrofoam, foam rubber or the like. The valance body and brackets may be sheet metal or any other suitably rigid material. The clip and end piece may be sheet metal or any suitable flexibly rigid plastic.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. A decorative valance having a body with an upper and lower edge, the valance having the upper edge turned back on the body of the valance and spaced from the body to form a downwardly facing groove, and the lower edge turned back on the body of the valance and spaced from the body to form an upwardly facing groove, the valance comprising:

cornice padding having upper and lower edges and two ends, the padding upper edge being received by the downwardly facing groove in the valance, and the padding lower edge being received by the upwardly facing groove in the valance;

cornice padding having upper and lower edges and two ends, the padding upper edge being received by the downwardly facing groove in the valance, and the padding lower edge being received by the upwardly facing groove in the valance;

means for mounting the valance to a wall; and means for attaching the ends of the cornice padding to the mounting means.

2. The valance as defined in claim 1 wherein the cornice padding comprises means defining a longitudinal groove in said padding extending, along each of the padding upper and lower edges, for receiving each of the turned back portions of the valance.

3. The valance as defined in claim 1 wherein the cornice padding attaching means comprises a clip which fits around the cornice padding and engages the mounting means.

4. The valance as defined in claim 1 wherein the cornice padding attaching means comprises two-sided tape with adhesive coating on each of the two sides, one side being attached to the cornice padding, and the other side being attached to the mounting means.

5. A decorative valance having a body with telescoping sections and an upper and lower edge, the valance having the upper edge turned back on the body of the valance and spaced from the body to form a downwardly facing groove, and the lower edge turned back on the body of the valance and spaced from the body to form an upwardly facing groove, the valance comprising:

cornice padding having upper and lower edges and two ends, the padding upper edge being received by the downwardly facing groove in the valance, and the padding lower edge being received by the upwardly facing groove in the valance, the cornice padding further comprising a longitudinal groove, spaced from each of the padding upper and lower edges, for receiving each of the turned back portions of the valance;

end pieces removably attached to the valance, each end piece having an aperture;

a mounting bracket having a first and second end, the first end having means for attaching the bracket to a wall, and the second end having a tab for snap-fit attachment with the end piece aperture; and a clip which fits around one end of the cornice padding and engages the mounting bracket.

6. A decorative valance having a body with a front, a back, and an upper and lower edge, the valance comprising:

cornice padding having two ends, the cornice padding disposed on the front of the body;

means for mounting the valance to a wall;

means for attaching the cornice padding to the front of the body and to the mounting means; and valance support means for supporting the valance upon a wall;

said valance support means including a wall bracket having a first and a second end, the first end having means for attaching the wall bracket to the wall, the second end having a center support, the center support having two legs; and a center support bracket engaging each of the valance body upper and lower edges and covering the back of the valance body, the center support bracket having longitudinal apertures spaced to receive the two legs of the center support.

7. The valance as defined in claim 6 wherein the valance support means further comprises a center support cover hingedly attached to an upper edge of the center support bracket, the cover fitting around the cornice padding and engaging a lower edge of the center support bracket.

8. The valance as defined in claim 6 wherein the cornice padding attaching means comprises:

a first clip which fits around the cornice padding and engages each of the valance body upper and lower edges; and a second clip which fits around one of the cornice padding ends and engages the wall bracket.

9. The valance as defined in claim 6 wherein the cornice padding attaching means comprises two-sided tape with adhesive coating on each of the two sides, one side being attached to the cornice padding, and the other side being attached to the front of the valance and to the wall bracket.

10. A decorative valance having a body with telescoping sections and a front, a back, and an upper and lower edge, the valance comprising:

cornice padding having two ends, the cornice padding disposed on the front of the body;

end pieces removably attached to the valance, each end piece having an aperture;

a mounting bracket having a first and second end, the first end having means for attaching the bracket to a wall, and the second end having a tab for snap-fit attachment with the end piece aperture;

a first clip which fits around the cornice padding and engages each of the valance body upper and lower edges;

a second clip which fits around one of the cornice padding ends and engages the mounting bracket;

a wall bracket having a first and a second end, the first end having means for attaching the wall bracket to the wall, the second end having a center support, the center support having two legs;

a center support bracket engaging each of the valance body upper and lower edges and covering the back of the valance body, the center support bracket having longitudinal apertures spaced to receive the two legs of the center support; and a center support cover hingedly attached to an upper edge of the center support bracket, the cover fitting around the cornice padding and engaging a lower edge of the center support bracket.

* * * * *